US010364663B2

(12) United States Patent
Hohl et al.

(10) Patent No.: US 10,364,663 B2
(45) Date of Patent: Jul. 30, 2019

(54) DOWNHOLE OPERATIONAL MODAL ANALYSIS

(71) Applicants: Andreas Hohl, Hannover (DE); Mohamed Ichaoui, Braunschweig (DE); Hanno Reckmann, Nienhagen (DE)

(72) Inventors: Andreas Hohl, Hannover (DE); Mohamed Ichaoui, Braunschweig (DE); Hanno Reckmann, Nienhagen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 341 days.

(21) Appl. No.: 15/088,391

(22) Filed: Apr. 1, 2016

(65) Prior Publication Data

US 2017/0284185 A1 Oct. 5, 2017

(51) Int. Cl.

| | |
|---|---|
| ***E21B 44/02*** | (2006.01) |
| ***E21B 44/00*** | (2006.01) |
| ***E21B 47/00*** | (2012.01) |

(52) U.S. Cl.

CPC ..... *E21B 44/005* (2013.01); *E21B 47/00* (2013.01)

(58) Field of Classification Search

CPC . E21B 44/02; E21B 41/00; E21B 7/00; E21B 47/16; E21B 17/00

See application file for complete search history.

(56) References Cited

U.S. PATENT DOCUMENTS

| | | | |
|---|---|---|---|
| 4,291,978 | A | 9/1981 | Seigel |
| 4,821,563 | A | 4/1989 | Maron |
| 5,386,724 | A | 2/1995 | Das et al. |
| 5,705,810 | A | 1/1998 | Wang et al. |
| 6,587,211 | B1 | 7/2003 | Gelbart |
| 6,948,381 | B1 | 9/2005 | Discenzo |
| 7,586,083 | B2 | 9/2009 | Vahabzadeh et al. |
| 7,757,552 | B2 | 7/2010 | Bogath et al. |

(Continued)

FOREIGN PATENT DOCUMENTS

WO 2014186667 A1 11/2014

OTHER PUBLICATIONS

Hohl et al. "Derivation and experimental validation of an analytical criterion for the identification of self-excited modes in drilling systems." Journal of Sound and Vibration 342 (2015): 290-302.

(Continued)

*Primary Examiner* — Kandasamy Thangavelu

(74) *Attorney, Agent, or Firm* — Cantor Colburn LLP

(57) ABSTRACT

A method for selecting drilling parameters for drilling a borehole penetrating the earth with a drill string. The method includes: measuring vibration-related amplitudes of the drill string during operation using one or more vibrations sensor to provide amplitude measurements; determining with a downhole processor one or more modal properties comprising one or more eigenfrequencies of the drill string using the amplitude measurements, the determination being made by including any excitation force in a white noise term of a model of the drillstring; and selecting drilling parameters that apply an excitation force at a frequency that avoids a selected range of frequencies that bound the one or more eigenfrequencies using the processor.

14 Claims, 3 Drawing Sheets

(56) References Cited

U.S. PATENT DOCUMENTS

| | | | | |
|---|---|---|---|---|
| 7,889,332 | B2 | 2/2011 | Omichi et al. | |
| 7,973,914 | B2 | 7/2011 | Omichi et al. | |
| 8,171,805 | B2 | 5/2012 | Stevens | |
| 8,587,780 | B2 | 11/2013 | Gallet et al. | |
| 8,833,183 | B2 | 9/2014 | Blessum et al. | |
| 8,833,487 | B2 | 9/2014 | Krueger, IV et al. | |
| 2008/0060849 | A1* | 3/2008 | Entchev | E21B 17/00 175/56 |
| 2009/0216455 | A1 | 8/2009 | Reckmann et al. | |
| 2011/0077924 | A1 | 5/2011 | Ertas et al. | |
| 2011/0153217 | A1 | 6/2011 | Rodney | |
| 2012/0130693 | A1 | 5/2012 | Ertas et al. | |
| 2014/0231141 | A1 | 8/2014 | Hay et al. | |
| 2014/0260676 | A1 | 9/2014 | Janik et al. | |
| 2015/0021093 | A1 | 1/2015 | Clark et al. | |
| 2015/0083492 | A1 | 3/2015 | Wassell | |
| 2015/0088468 | A1* | 3/2015 | Hohl | E21B 41/00 703/2 |
| 2015/0122547 | A1 | 5/2015 | Hohl et al. | |
| 2015/0146192 | A1 | 5/2015 | Buck et al. | |
| 2015/0160082 | A1 | 6/2015 | Khoraych et al. | |
| 2015/0240614 | A1* | 8/2015 | Allen | E21B 7/00 175/40 |
| 2016/0069182 | A1* | 3/2016 | Neale | E21B 47/16 166/254.2 |
| 2016/0208597 | A1* | 7/2016 | Wang | E21B 44/02 |

OTHER PUBLICATIONS

Oueslati et al. "New Insights Into Drilling Dynamics Through High-Frequency Vibration Measurement and Modeling" IADC/SPE Drilling Conference and Exhibition. SPE, Sep. 30-Oct. 2, 2013., 15 pages.

Peeters, Bart, and Guido De Roeck. "Stochastic system identification for operational modal analysis: a review." Journal of Dynamic Systems, Measurement, and Control 123.4 (2001): 659-667.

Rudat, Jens, and Dmitriy Dashevskiy. "Development of an innovative model-based stick/slip control system." SPE/IADC 139996, Drilling Conference and Exhibition. Mar. 1-3, 2011 Society of Petroleum Engineers, 12 pages.

Notification of Transmittal of the International Preliminary Report of the International Searching Authority, or the Declaration; PCT/US2017/024993; dated Oct. 2, 2018, 11 pages.

Notification of Transmittal of the International Search Report of the International Searching Authority, or the Declaration; PCT/US2017/024993; dated Jun. 23, 2017, 3 pages.

Notification of Transmittal of the Written Opinion of the International Searching Authority, or the Declaration; PCT/US2017/024993; dated Jun. 23, 2017, 10 pages.

* cited by examiner

DOWNHOLE OPERATIONAL MODAL ANALYSIS

BACKGROUND

1. Field of the Invention

The present invention generally relates to drilling and, in particular, to performing, in a downhole location, modal analysis of a borehole.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface different types of tools and instruments may be disposed in the boreholes to perform various tasks and measurements.

In more detail, wellbores or boreholes for producing hydrocarbons (such as oil and gas) are drilled using a drill string that includes a tubing made up of jointed tubulars or a continuous coiled tubing that has a drilling assembly, also referred to as the bottom hole assembly (BHA), attached to its bottom end. The BHA typically includes a number of sensors, formation evaluation tools, and directional drilling tools. A drill bit attached to the BHA is rotated with a drilling motor in the BHA and/or by rotating the drill string to drill the wellbore. While drilling, the sensors can determine several attributes about the motion and orientation of the BHA that can used, for example, to determine how the drill string will progress. Further, such information can be used to detect or prevent operation of the drill string in condition that is less than favorable. One example that is considered is vibrations that may be created in the drill string.

Severe vibrations in drill strings and associated bottom-hole assemblies can be caused by cutting forces at the bit or mass imbalances in downhole tools such as mud motors. Vibrations can be differentiated into axial, torsional and lateral direction. Negative effects due to the severe vibrations are among others reduced rate of penetration, reduced quality of measurements and downhole failures. Hence, improvements in drill string operations that prevent severe vibrations would be appreciated in the drilling industry.

SUMMARY

Disclosed herein is a method for selecting drilling parameters for drilling a borehole penetrating the earth with a drill string. The method includes: measuring vibration-related amplitudes of the drill string during operation using one or more vibrations sensor to provide amplitude measurements; determining with a downhole processor one or more modal properties comprising one or more eigenfrequencies of the drill string using the amplitude measurements, the determination being made by including any excitation force in a white noise term of a model of the drillstring; and selecting drilling parameters that apply an excitation force at a frequency that avoids a selected range of frequencies that bound the one or more eigenfrequencies using the processor.

Also disclosed is a method for selecting drilling parameters for drilling a borehole penetrating the earth with a drill string that includes: constructing a mathematical model of the drill string comprising dimensions and mass distribution of the drill string; forming a mathematical model of the drill string that includes any excitation stimulus being included as noise; measuring amplitudes of vibrations of the drill string due to the applied excitation forces using the plurality of vibration sensors to provide amplitude measurements; determining with a downhole processor one or more modal properties comprising one or more eigenfrequencies of the drill string using the amplitude measurements and the mathematical model; selecting drilling parameters that apply an excitation force at a frequency that avoids a selected range of frequencies that bound the one or more eigenfrequencies using the processor; and transmitting the selected drilling parameters to a drill string controller configured to control the drill string in accordance with the selected drilling parameters.

Additionally disclosed is a method for selecting drilling parameters for drilling a borehole penetrating the earth with a drill string. This method includes: measuring vibration-related amplitudes of the drill string during operation using one or more vibrations sensor to provide amplitude measurements; determining with a downhole processor one or more modal properties comprising one or more eigenfrequencies of the drill string using the amplitude measurements, the determination being made by without regard to any excitation force in a model of the drillstring; and selecting drilling parameters that apply an excitation force at a frequency that avoids a selected range of frequencies that bound the one or more eigenfrequencies using the processor.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods and apparatus for selecting a drilling parameter for drilling a borehole with a drill string. The selected drilling parameter or parameters (e.g., string RPM, bit RPM, WOB, and the like) reduce or mitigate vibrations and thus improve the rate of penetration and reduce the risk of equipment damage. Consequently, boreholes may be drilled more efficiently and cost effectively. The method and apparatus vary an excitation frequency of a stimulus applied to the drill string. The excitation frequency may include multiple frequencies applied simultaneously, sequentially or some combination thereof. Similarly, the stimulus may include multiple stimuli or multiple stimulation sources. The resulting amplitudes of vibrations due to one stimulus or multiple stimuli are measured by one or more sensors. However, the stimulus, in embodiments herein is not known. In such a case, the stimulus or "excitation force" is not known. In those situations, the excitation force may be removed as a separate term from a state space model of the drill sting and simply expressed as or included in the noise (e.g., white noise) measured in the system. In short, embodiments herein may solve for vibrational effects (including eigenfrequencies, mode shapes, modal damping) without knowing and/or without considering the excitation force in the determination of the effects. Stated differently, the excitation force may or may not be known but is included in a noise term or the model.

The vibrations may be lateral, axial and/or torsional. From the amplitudes and/or phase information, vibrational characteristics of the drilling system such as modal properties (e.g., one or more eigenfrequencies, modal damping factors, mode shapes or stability factors) are identified. Operational drilling parameters are then selected to avoid severe vibrations induced by an excitation source that may damage the drilling system. The severe vibrations may result from a resonance in the drilling system where the excitation frequency equals an eigenfrequency. The selected operational parameters in one or more embodiments may be transmitted automatically to a controller for controlling the drilling parameters while a borehole is being drilled, thus, avoiding severe vibrations of the drill string.

Figure 1:
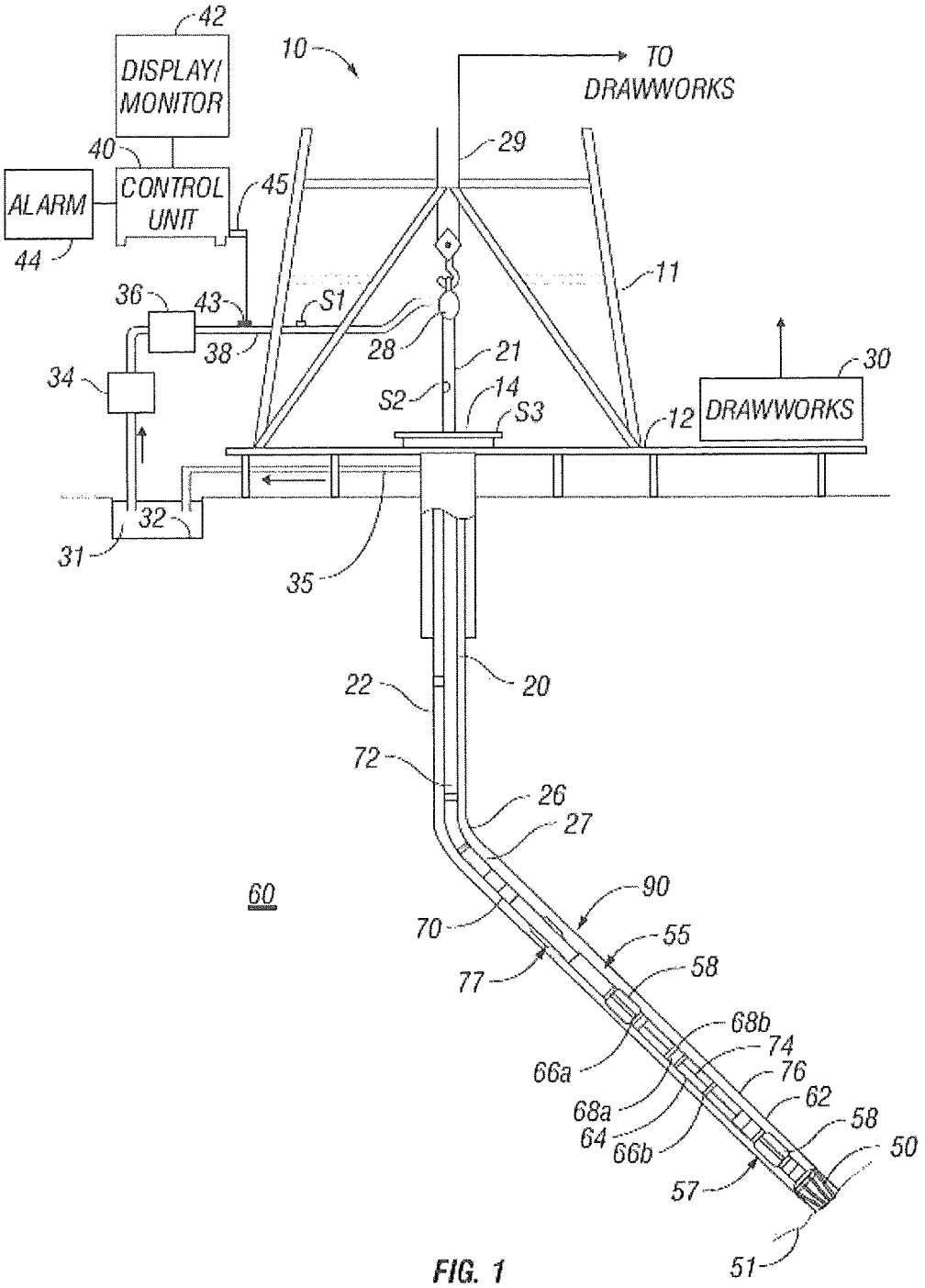
FIG. 1 is an exemplary drilling system.

FIG. 1 shows a schematic diagram of a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A drill bit 50, attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26.

In some applications the drill bit 50 is rotated by only rotating the drill pipe 22. However, in other applications, a drilling motor 55 (mud motor) disposed in the drilling assembly 90 is used to rotate the drill bit 50 and/or to superimpose or supplement the rotation of the drill string 20. In either case, the rate of penetration (ROP) of the drill bit 50 into the borehole 26 for a given formation and a drilling assembly largely depends upon the weight on bit and the drill bit rotational speed. In one aspect of the embodiment of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the drill bit 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the drill bit 50 via a hollow shaft that also enables the drilling fluid to pass from the mud motor 55 to the drill bit 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the drill bit 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*.

Severe vibrations in drillstrings and bottomhole assemblies can be caused by cutting forces at the bit or mass imbalances in downhole tools such as mud motors. Negative effects are among others reduced rate of penetration, reduced quality of measurements and downhole failures. It is important to find drilling parameters (string RPM, bit RPM, WOB, . . . ) that reduce or mitigate vibrations.

In the embodiment of FIG. 1, a plurality of vibration sensors 100 (see FIG. 2) are disposed in the BHA 10 and/or along the drill string 20. In other embodiments one or more vibration sensors 100 may be at one location or at multiple locations on the drill string. Each vibration sensor 100 is configured to measure an amplitude of vibration or acceleration either laterally, axially, and/or torsionally, an amplitude of deflection, an amplitude of velocity, and/or an amplitude of a bending moment. The plurality of vibration sensors are configured to provide sensed amplitudes to the downhole electronics and/or the surface computer processing system.

One way to model a system is to utilize so called "Lumped mass models" or models based on the discretization of the structure such as the finite element method exist to capture the dynamics of the bottomhole assembly (BHA). These models can be very sensitive against changes of parameters like the borehole geometry or the model of fluid damping. This is especially true for lateral vibrations. In many cases the excitation forces (e.g., input torque) cannot be modeled quantitatively. Further time domain applications that are potentially more accurate are connected with very high computational effort.

A downhole identification of eigenfrequencies/resonances and the modal damping of the structure (e.g., drill string) are disclosed that may allow for determination of improved or optimal drilling parameters. These parameters may be provided to an operator who causes the operation of the drilling system to change based on them in one embodiment. In another embodiment, the improved or optimal drilling parameters may be determined by a computing device and automatically implemented. Further, in some cases, rather than parameters to operate under (e.g, optimal parameters), sub-optimal or worse case operating parameters and the provided to the operator such that the operator (either human or automatic) does not select such parameters. For example, in one embodiment, the systems and methods disclosed herein may allow for the avoidance of lateral resonances with low damping by changing operational parameters (rotary speed, flow rate, weight on bit).

Figure 2:
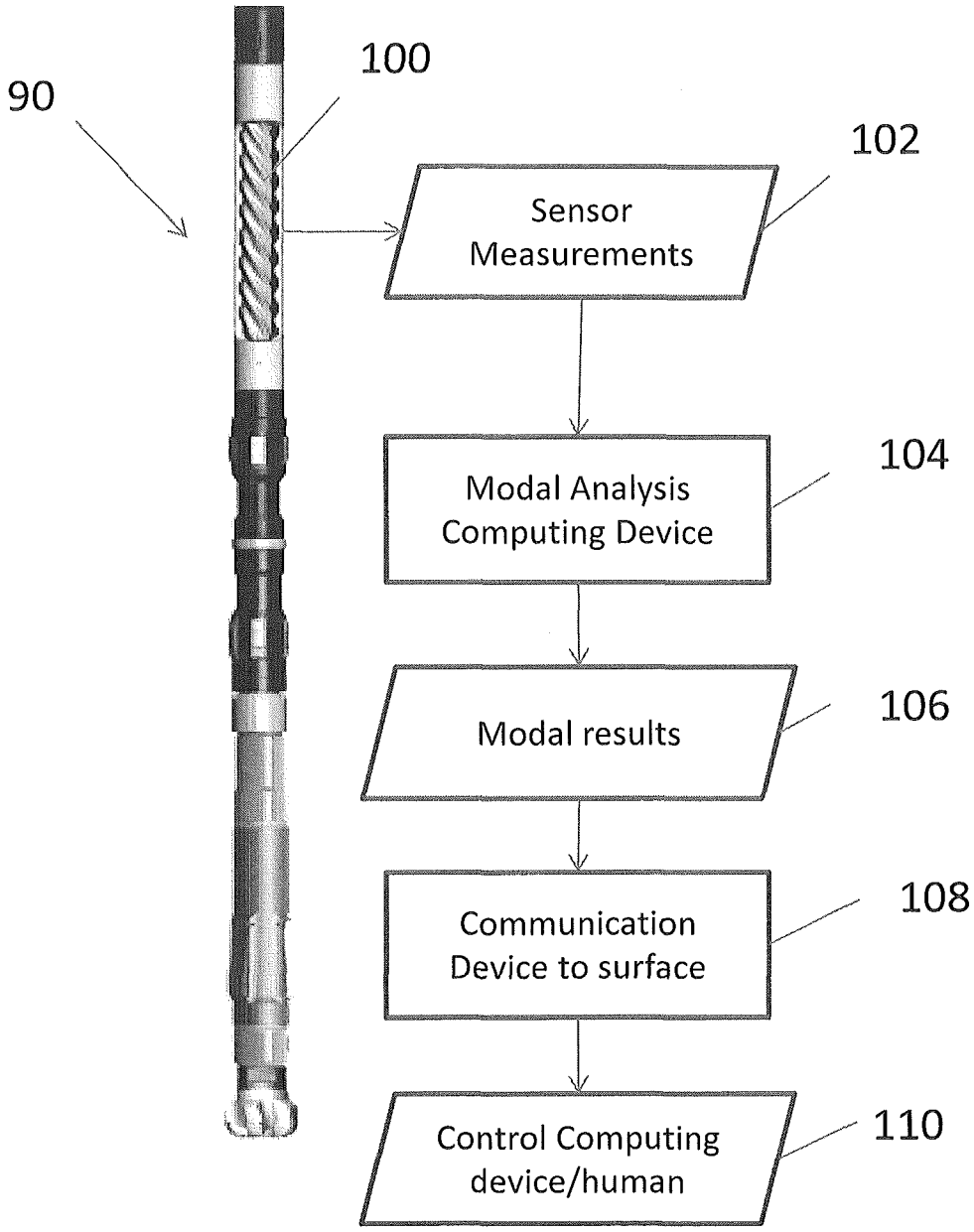
FIG. 2 is functional block diagram of a bottom hole assembly and method performed at least partially therein.

FIG. 2 shows a BHA 90 that includes one or more sensors that are generally shown as element 100. The sensors may be a single sensor or multiple sensors. The sensors 100 may, in one embodiment, measure deflection, velocity and accelerations or any other motion as described above. The data produced by such sensors 100 is shown as sensor data 102. The data is analyzed by a computing device 104 that may be included in the BHA 90. For clarity, the computing device 104 is shown as external to the BHA 90 but it shall be understood that it may be included in the BHA in one embodiment. The computing device 104 performs an operational modal analysis based on the sensor data 102. The output of this analysis is shown as modal results 106.

In some instances, a string may be modeled and its modal results determined. In such cases, the excitation force, e.g., input torque, is known or set. In the teachings herein, as the modal analysis is being performed downhole, the excitation force is or may be unknown. In one embodiment, the excitation forces are assumed to be white noise that leads to simplification in the derivation of the modal parameters (eigenfrequencies, mode shapes, modal damping) from measurement data. The knowledge of eigenfrequencies and modal damping may be beneficial to find optimal drilling parameters. This is especially useful to avoid resonances with the rotary speed/mud motor excitation to avoid severe lateral vibrations. Based on this knowledge, certain information may be determined or analysis performed. For instance, stability analysis in cases of torsional vibrations (stick/slip or high-frequency torsional oscillations), identification of unknown modal properties for load estimation with Kalman filter techniques (at non-measurement positions along the BHA), avoidance of lateral resonances with low damping by changing operational parameters (rotary speed, flow rate, weight on bit), health monitoring of components by examining changing eigenfrequencies (eigenfrequencies change as a crack grows—if new eigenfrequencies are identified this could indicate failures)

In general, as and described, above, the modal analysis at device 104 determines modal results 106 that include one or more of eigenfrequencies, modal damping and modal shapes. This analysis includes operating with a discrete state space formulation of the structure is assumed where sensors and excitation are assumed to be disturbed by white noise. This leads to a so-called stochastic state space model. The assumption of white noise excitation leads to simplifications. It can be shown that the mathematical model can be interpreted as an impulse response of the underlying matrices. The derivation of modal parameters from an impulse response is well known in this context. In a second step it can be shown that the state matrix can then be calculated from a singular value decomposition of time-based measurement data. A modal analysis of the state matrix directly leads to eigenfrequencies, modal damping and eigenvectors (limited to the measurement positions) of the system.

In more detail, Multi-degree-of-freedom (MDOF) systems are usually described by the differential equation:

$$M\ddot{q}+C^{q}\dot{q}+Kq=F(t)=B_2u(t).$$

The matrices M, Cq,K are the mass, damping and stiffness matrix of the dimension $n_2$xm. Respectively $n_2$ is the number of degree of freedom (DOF) of the discretized dynamic system. B2 is a matrix of size $n_2$xm that applies the m different forces of u(t) onto the DOFs of the system. The above MDOF equation can be transformed into a state space equation by defining the following terms:

$$x(t)=\begin{bmatrix} q \\ \dot{q} \end{bmatrix},\ A_c=\begin{bmatrix} 0 & I \\ -M^{-1}K & -M^{-1}C^{q} \end{bmatrix},\ B_c=\begin{bmatrix} 0 \\ M^{-1}B_2 \end{bmatrix}$$

with the continuous state-space model:

$$x(t)=A_cx(t)+B_cu(t)$$

where:

$$A_c \text{ and } B_c\in\mathbb{R}^{nxn}, n=2n_2$$

are defined as the so called state or system matrix and input matrix of the state-space model. The outputs of interest can be determined by:

$$y(t)=Cx(t)+Du(t)$$

where $$C=[C_d-C_aM^{-1}K\ C_v-C_aM^{-1}C^{q}], D=C_aM^{-1}B_2$$

are the output and direct transmission matrix. The output matrix C consists of the output matrices $$C_d, C_v, C_a\in\mathbb{R}^{m_2xn_2}$$

for displacement, velocity and acceleration. $m_2$ represents the number of outputs.

Since all measured data is sampled at discrete point of time. The continuous model needs to by transferred to the discrete state-space model:

$$x_{k+1}=Ax_k+Bu_k; \text{ and}$$

$$y_k=Cx_k+Du_k$$

where $x_k$=x(kΔt) states the time discretization. Process noise $w_k$ due to disturbance and modeling inaccuracies and measurement noise vk caused by sensor inaccuracy are added to the state and output vector leading to the discrete stochastic-deterministic state space model:

$$x_{k+1}=Ax_k+Bu_k+w_k,$$

$$y_k=Cx_k+Du_k+v_k.$$

Herein, the $u_k$ terms of the stochastic-deterministic state spacemodel are eliminated and the system is considered to be described by the stochastic statespace model. Thus the excitation is may, in embodiment, be modeled by white noise resulting in $$x_{k+1}=Ax_k+w_k,$$

$$y_k=Cx_k+v_k.$$

Figure 3:
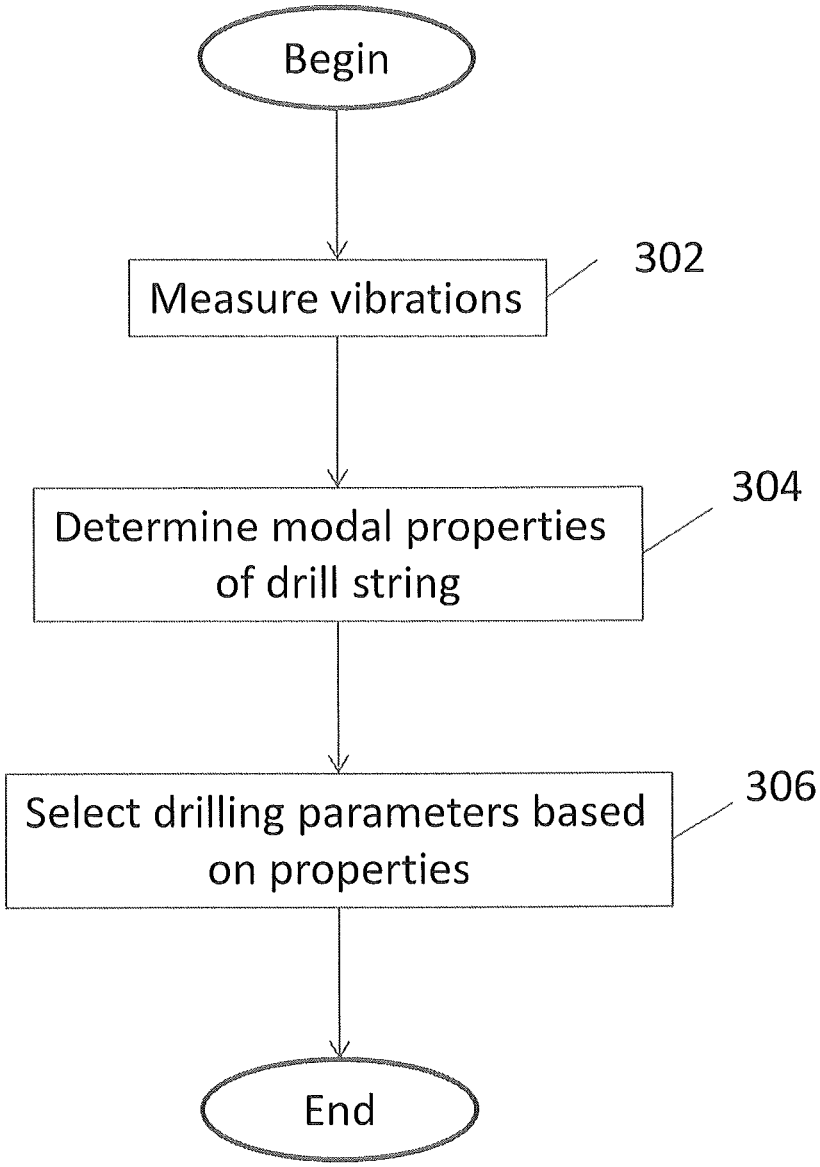
FIG. 3 is flow chart of method according to one embodiment.

FIG. 3 is a flow chart for a method for selecting drilling parameters for drilling a borehole penetrating the earth with a drill string. Block 302 calls for measuring vibration-related amplitudes of the drill string due to the applied excitation force using a vibration sensor to provide amplitude measurements. Non-limiting embodiments of the vibration-related amplitudes include vibration amplitude, deflection amplitude, velocity amplitude, and bending moment amplitude. In one or more embodiments, the sensor is disposed in a bottomhole assembly of the drill string. In one or more embodiments, the vibration-related amplitudes are measured in a frequency domain and/or a frequency domain. In one or more embodiments, the sensor represents a plurality of sensors that may be in one location or a plurality of locations distributed along the drill string. In one or more embodiments, the sensor or sensors are disposed at locations that are not nodes of a modal shape of the drill string. Block 304 calls for determining with a processor one or more modal properties having one or more eigenfrequencies of the drill string using the amplitude measurements. The modal properties may include a modal shape and/or modal damping. According to one embodiment, determining the modal properties can be done without knowing the excitation or including it a white noise term of a model of the drill string.

Block 306 calls for selecting drilling parameters that apply an excitation force at a frequency that avoids a selected range of frequencies that bound the one or more eigenfrequencies. The selection may be done by a human or automatically using a control processor. By avoiding the selected range of frequencies, severe vibrations due to resonance of the drill string can be avoided. In general, the range of frequencies that bound the one or more eigenfrequencies is selected so that damage to the drill string is prevented. For example, operation of the drill string outside of the selected range provides for operation of drill string components within their operational specifications or design parameters. Stated in other words, the range to be avoided may be selected such that the drill string components would exceed their operational specifications or design parameters if operated within that range. Margins that encompass sensor error may be added to the selected range may be used to help insure that the drilling parameters do not cause resonant vibrations of the drill string.

The method in FIG. 3 may also include drilling the borehole with a drilling rig using the selected drilling parameters in order to prevent or limit drill string vibrations. The method may also include transmitting the selected drilling parameters to a drill string controller configured to control the drill string in accordance with the selected drilling parameters. The method may also include controlling one or more drilling parameters using a feedback controller that receives input from a drilling parameter sensor in accordance with a signal received from a processor that selected the drilling parameters that avoid the eigenfrequencies. The signal includes one or more setpoints of drilling parameters that avoid the eigenfrequencies. It can be appreciated that the one or more setpoints can be transmitted to the drill string controller in real time as soon as sensor data is received and eigenfrequencies are determined.

The method may also include constructing a mathematical model of the drill string comprising dimensions and mass distribution of the drill string; determining a location of one or more nodes of the modal shape. The mathematical model may include a shape and dimensions of the borehole and the drill string being disposed in the borehole so that impacts with the borehole wall may be modeled.

Embodiment 1. According to one embodiment, a method for selecting drilling parameters for drilling a borehole penetrating the earth with a drill string includes measuring vibration-related amplitudes of the drill string during operation using one or more vibrations sensor to provide amplitude measurements; determining with a downhole processor one or more modal properties comprising one or more eigenfrequencies of the drill string using the amplitude measurements, the determination being made by including any excitation force in a white noise term of a model of the drillstring; and selecting drilling parameters that apply an excitation force at a frequency that avoids a selected range of frequencies that bound the one or more eigenfrequencies using the processor.

Embodiment 2. The method of embodiment 1 wherein the one or more modal properties further comprise modal shape and/or modal damping.

Embodiment 3. The method of any prior embodiment further comprising drilling the borehole with a drilling rig using the selected drilling parameters.

Embodiment 4. The method of any prior embodiment wherein the excitation device comprises a mud-motor and varying a frequency comprises varying a flow rate of drilling fluid through the drill string.

Embodiment 5. The method of any prior embodiment wherein varying a flow rate comprises varying at least one of a drilling fluid pump speed and a drilling fluid flow valve.

Embodiment 6. The method of any prior embodiment, wherein the sensor is disposed in a bottomhole assembly of the drill string.

Embodiment 7. The method of any prior embodiment further comprising: constructing a mathematical model of the drill string comprising dimensions and mass distribution of the drill string; and analyzing a response of the mathematical model to during operation to provide the modal shape of the drill string.

Embodiment 8. A method for selecting drilling parameters for drilling a borehole penetrating the earth with a drill string, the method comprising: measuring vibration-related amplitudes of the drill string during operation using one or more vibrations sensor to provide amplitude measurements; determining with a downhole processor one or more modal properties comprising one or more eigenfrequencies of the drill string using the amplitude measurements, the determination being made by without regard to any excitation force in a model of the drillstring; and selecting drilling parameters that apply an excitation force at a frequency that avoids a selected range of frequencies that bound the one or more eigenfrequencies using the processor.

Embodiment 9. The method any prior embodiment, wherein the one or more modal properties further comprise modal shape and/or modal damping.

Embodiment 10. The method of any prior embodiment further comprising drilling the borehole with a drilling rig using the selected drilling parameters.

Embodiment 11. The method of any prior embodiment, wherein the excitation device comprises a mud-motor and varying a frequency comprises varying a flow rate of drilling fluid through the drill string.

Embodiment 12. The method of any prior embodiment wherein the sensor is disposed in a bottomhole assembly of the drill string.

Embodiment 13. The method of any prior embodiment, further comprising: constructing a mathematical model of the drill string comprising dimensions and mass distribution of the drill string; and analyzing a response of the mathematical model to during operation to provide the modal shape of the drill string.

Embodiment 14. A method for selecting drilling parameters for drilling a borehole penetrating the earth with a drill string includes: constructing a mathematical model of the drill string comprising dimensions and mass distribution of the drill string; forming a mathematical model of the drill string that includes any excitation stimulus being included as noise; measuring amplitudes of vibrations of the drill string due to the applied excitation forces using the plurality of vibration sensors to provide amplitude measurements; determining with a downhole processor one or more modal properties comprising one or more eigenfrequencies of the drill string using the amplitude measurements and the mathematical model; selecting drilling parameters that apply an excitation force at a frequency that avoids a selected range of frequencies that bound the one or more eigenfrequencies using the processor; and transmitting the selected drilling parameters to a drill string controller configured to control the drill string in accordance with the selected drilling parameters.

Embodiment 15. The method of any prior embodiment wherein the operator is a computing device.

Embodiment 16. The method of any prior embodiment wherein the operator is a human.

In support of the teachings herein, various analysis components may be used, including digital and/or analog systems. The digital and/or analog systems may be included, for example, in the downhole electronics unit 42 or the processing unit 28. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs, USB flash drives, removable storage devices), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for selecting drilling parameters for drilling a borehole penetrating the earth with a drill string, the method comprising:

forming a mathematical model of the drill string;

measuring vibration-related amplitudes of the drill string during operation using one or more vibration sensors to provide amplitude measurements;

determining with a downhole processor one or more modal properties of the drill string based on the mathematical model and the amplitude measurements, the one or more modal properties comprising one or more eigenfrequencies of the drill string, the determination being made by including any excitation force as white noise term of the mathematical model of the drill string;

selecting an operational frequency of an excitation device that provides the excitation force to the drill string at a frequency that avoids a selected range of frequencies that bound the one or more eigenfrequencies using the processor; and drilling the borehole with a drilling rig using the selected frequency.

2. The method according to claim 1, wherein the one or more modal properties further comprise a modal shape of vibration of the drill string and/or modal damping.

3. The method according to claim 1, wherein the excitation device comprises a mud-motor and drilling the borehole comprises varying a flow rate of drilling fluid through the drill string.

4. The method according to claim 3, wherein varying a flow rate comprises varying at least one of a drilling fluid pump speed and a drilling fluid flow valve opening.

5. The method according to claim 1, wherein the sensor is disposed in a bottomhole assembly of the drill string.

6. The method according to claim 1, further comprising:

constructing the mathematical model of the drill string comprising dimensions and mass distribution of the drill string; and analyzing a response of the mathematical model during operation to provide the modal shape of vibration of the drill string.

7. A method for selecting drilling parameters for drilling a borehole penetrating the earth with a drill string, the method comprising:

forming a mathematical model of the drill string;

measuring vibration-related amplitudes of the drill string during operation using one or more vibration sensors to provide amplitude measurements;

determining with a downhole processor one or more modal properties of the drillstring based on the mathematical model and the amplitude measurements, the one or more modal properties comprising one or more eigenfrequencies of the drill string, the determination being made without any excitation force in the model of the drillstring; and selecting an operational frequency of an excitation device that provides the excitation force to the drill string at a frequency that avoids a selected range of frequencies that bound the one or more eigenfrequencies using the processor; and drilling the borehole with a drilling rig using the selected frequency.

8. The method according to claim 7, wherein the one or more modal properties further comprise a modal shape of vibration of the drill string and/or modal damping.

9. The method according to claim 7, wherein the excitation device comprises a mud-motor and drilling the borehole comprises varying a flow rate of drilling fluid through the drill string.

10. The method according to claim 7, wherein the sensor is disposed in a bottomhole assembly of the drill string.

11. The method according to claim 9, further comprising:

constructing the mathematical model of the drill string comprising dimensions and mass distribution of the drill string; and analyzing a response of the mathematical model during operation to provide the modal shape of vibration of the drill string.

12. A method for selecting drilling parameters for drilling a borehole penetrating the earth with a drill string, the method comprising:

constructing a mathematical model of the drill string comprising dimensions and mass distribution of the drill string;

forming the mathematical model of the drill string that includes any excitation stimulus being included as noise;

measuring amplitudes of vibrations of the drill string due to excitation forces using plurality of vibration sensors to provide amplitude measurements;

determining with a downhole processor one or more modal properties of the drillstring based on the mathematical model and the amplitude measurements, the one or more modal properties comprising one or more eigenfrequencies of the drill string;

selecting an operational frequency of an excitation device that provides the excitation forces to the drill string at a frequency that avoids a selected range of frequencies that bound the one or more eigenfrequencies using the processor;

transmitting the selected frequency to a drill string controller configured to control the drill string in accordance with selected frequency; and drilling the borehole with a drilling rig using the selected frequency.

13. The method of claim 12, wherein the controller is a computing device.

14. The method of claim 12, wherein the controller is a human.

* * * * *